US006409053B2

(12) United States Patent
Stössel

(10) Patent No.: US 6,409,053 B2
(45) Date of Patent: Jun. 25, 2002

(54) PISTON FOR CLOSING A CARTRIDGE

(75) Inventor: Willy Stössel, Aesch (CH)

(73) Assignee: Stebler & Co. AG, Nunningen (CH)

( * ) Notice: Subject to any disclaimer, the term of this patent is extended or adjusted under 35 U.S.C. 154(b) by 0 days.

(21) Appl. No.: 09/746,629

(22) Filed: Dec. 21, 2000

(30) Foreign Application Priority Data

Jan. 11, 2000 (CH) ..... 46/00

(51) Int. Cl.[7] ..... B67D 5/42
(52) U.S. Cl. ..... 222/386
(58) Field of Search ..... 222/105, 325, 222/326, 327, 386

(56) References Cited

U.S. PATENT DOCUMENTS 4,854,485 A * 8/1989 Collins ..... 222/386
5,127,556 A * 7/1992 Sporri ..... 222/386
5,170,913 A * 12/1992 Spatz ..... 222/386

FOREIGN PATENT DOCUMENTS

DE 9714331 5/1998
EP 0900599 10/1999
GB 2071268 9/1981

* cited by examiner

*Primary Examiner*—Philippe Derakshani
*Assistant Examiner*—Thach H. Bui
(74) *Attorney, Agent, or Firm*—Sidley Austin Brown & Wood, LLP

(57) ABSTRACT

Known cartridges have a cylindrical container part comprising an outlet nozzle arranged at the front, closed end and a piston inserted into the orifice in the rear end and movable in the longitudinal direction of the cartridge and intended for sealing the interior of the cartridge and ejecting the flowable material. The invention relates to such a piston. This is essentially in the form of a cylinder which is closed at one end and whose external diameter is at least as large as the internal diameter of the cylindrical container part. It is thus dimensioned so that, for closing the cartridge, it is pressed with a tight fit into the container part. The cylindrical sidewall of the press piston is in addition provided with at least one bevel starting from the end wall, so that, when the piston is pressed into the container part of the cartridge, the at least one bevel, together with the cylindrical wall of the container part, briefly forms a passage through which the air displaced by the piston can escape outwards, and that consequently no residual air remains in the cartridge and triggers undesirable hardening of the flowable material inside the container part.

7 Claims, 1 Drawing Sheet

PISTON FOR CLOSING A CARTRIDGE

DESCRIPTION

Figure 1:
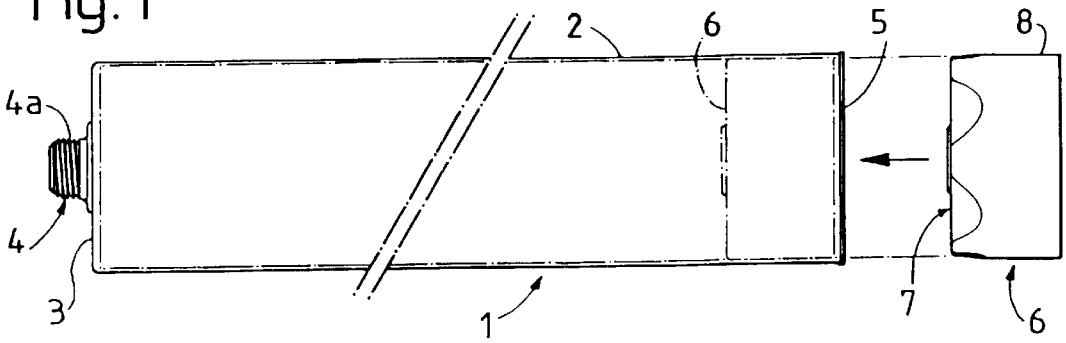

The invention relates to a piston for closing or sealing a cartridge, namely a piston for insertion into the cylindrical container part of a cartridge which serves for holding a flowable material and which comprises a cylindrical sidewall and an end wall.

Cartridges are intended for holding a flowable material and are used, for example, wherever a possibly moisture-sensitive, flowable material has to be applied in portions in grooves, joints and the like. The cartridges used in building and in industry are produced today in particular from aluminium. They have a cylindrical container part with an outlet nozzle arranged at the front end and a piston inserted into the orifice in the rear end and movable in the longitudinal direction of the cartridge and intended for sealing the interior of the cartridge and ejecting the flowable material. The material is usually ejected by using a hand-operated injection gun with a plunger which is tailored to the piston and moves the piston towards the outlet nozzle when the cartridge is used.

In a known method for closing filled cartridges, the inner surface of the cylindrical container part is provided, in the region of the rear end section, with an all-round wax layer serving as a sealant, and subsequently a piston whose external diameter is smaller than the internal diameter of the container part is inserted into the container part. This has the advantage that, when the piston is inserted, the air present in the interior of the cartridge and displaced by the piston can readily escape outwards, but, on the other hand, the disadvantage that for a fluid- and gas-tight seal, the piston inserted into the container part must subsequently also be pressed, i.e. expanded, by the container part, which is usually effected by means of an expanding device specially provided for this purpose.

It is the object of the invention to provide a novel piston for cartridges of the above-mentioned type which makes it possible to simplify the fluid- and gas-tight sealing of the cartridge in such a way that it is possible to dispense with the expansion, i.e. with the additional use of an expansion device.

This object is achieved by a piston, which comprises a cylindrical sidewall (8), which is at least as large as the internal diameter of the cylindrical container part of the cartridge, wherein the cylindrical sidewall is provided with at least one bevel starting from the end wall and dimensioned in such a way that it can be pressed with a tight fit into the container part and that, when the piston is pressed in, the at least one bevel, together with the cylindrical wall of the container part briefly forms a passage through which the air displaced by the piston can escape outwards.

The novel piston, also referred to below as press piston, is distinguished essentially by the fact that it is in the form of a cylinder which is closed at one end and whose external diameter is also at least as large as the internal diameter of the cylindrical container part. The piston according to the invention is thus dimensioned so that it already has a tight fit when inserted into the container part. Although this is not possible without additional application of force, it can readily be effected by means of a conventional, axially operating press device. The advantage of this procedure is obvious. Thus, it is possible to dispense with the subsequent expansion of the piston by means of a device specially provided for this purpose.

In addition, the cylindrical sidewall of the piston according to the invention is provided with at least one bevel starting from the end face, so that, when the piston is pressed into the container part of the cartridge, the at least one bevel, together with the cylindrical wall of the container part, briefly forms a passage through which the air displaced by the piston can escape outwards, and that consequently no excess pressure adversely affecting the tightness of the cartridge is generated in the interior of the cartridge and in particular no residual air remains in the cartridge and triggers a chemical reaction, for example undesired hardening of the flowable material inside the container part.

The press pistons according to the invention preferably consist of metallic material, for example of tin plate or aluminium.

It is expedient to provide at least two, preferably four or six, bevels arranged symmetrically with respect to one another. Such an embodiment of the press piston according to the invention leads to optimum venting of the cartridge when the piston is pressed into the container part, and does so with constant moisture and sealing properties so that the shelf-life and operational safety of cartridges sealed by means of press pistons according to the invention is ensured.

The bevels according to the invention do not cover the total circumference of the cylindrical sidewall and are—as is evident from the drawing explained below—essentially dent-like recesses in the cylindrical sidewall.

An embodiment of the invention is described below with reference to the attached drawing. In the drawing, FIG. 1 shows a cartridge for holding a high-viscosity or low-viscosity material and a press piston intended to be inserted into the cartridge, FIG. 2 shows a plan view of the end face of the press piston according to the invention and shown on a larger scale, and FIG. 3 shows a section along the line III of FIG. 2.

The cartridge shown in FIG. 1 is denoted as a whole by 1 and has a cylindrical container part 2 for holding a flowable material, such as, for example, a polyurethane-containing sealant. The container part 2 has an end face 3 with an outlet nozzle 4. The latter preferably has an external thread 4*a*, onto which an outlet tip, which is not shown, is screwed for using the cartridge 1.

That end 5 of the container part 2 which is opposite the end face 3 is open and, after the cartridge 1 has been filled, is closed fluid- and gas-tight with the press piston 6 according to the invention.

Figure 2:
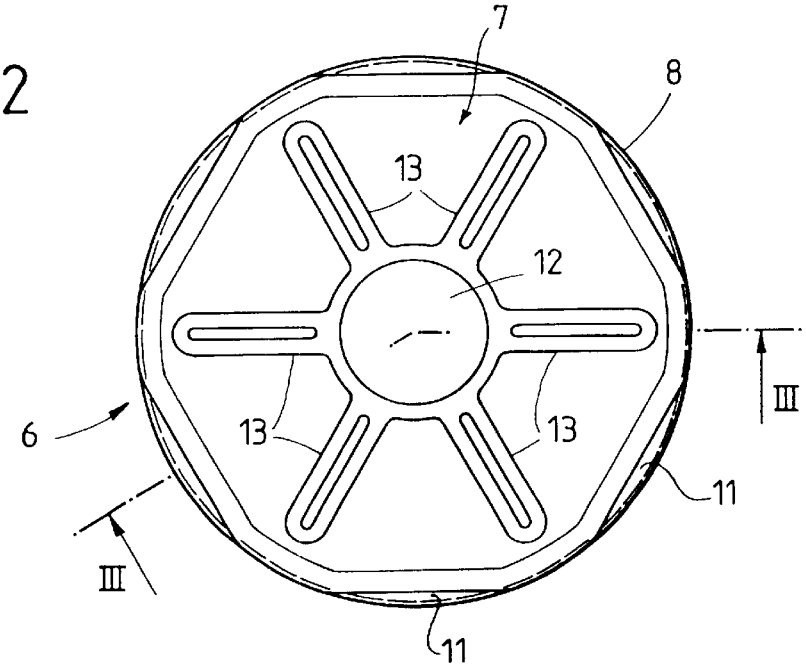
Figure 3:
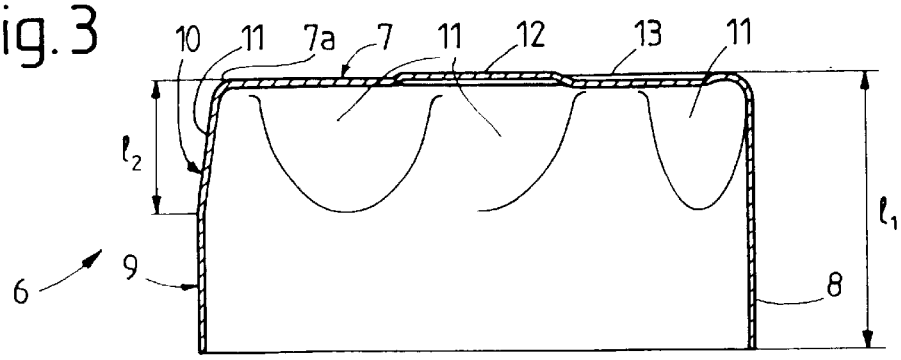

The press piston 6 shown on a larger scale in FIGS. 2 and 3 preferably consists of aluminium and has an end wall 7 intended for facing the outlet 4 of the cartridge 1 and an essentially cylindrical sidewall 8 having the length $l_1$. The latter is divided into a first cylinder section 9 facing away from the end wall 7 and a second cylinder section 10 facing the end wall 7.

The wall thickness of the press piston 6 is 0.2 mm–1 mm, but preferably 0.4 mm. No subsequent expansion of the piston 6 is necessary for the fluid- and gas-tight sealing of the interior of the cartridge, said piston has an external diameter which is at least as large as the internal diameter of the cylindrical container part 2, but is not more than about 2%, for example 1%, larger than said internal diameter.

As is clearly evident in particular from FIG. 3, the second cylinder section 10 is provided with six bevels 11 which are arranged symmetrically around the circumference of the cylinder section 10, start from the end edge 7*a* and extend over the entire length of the cylinder section 10, and become narrower with increasing distance from the rounded end edge 7*a*.

The length $l_2$ of the second cylinder section 10 is preferably chosen so that the relationship $$\frac{1}{4}\cdot l_1 \leq l_2 \leq \frac{2}{3}\cdot l_1$$

is fulfilled. Thus, the length $l_2$ of the cylinder section 10 is always at least ¼ and not more than ⅔ of the total length $l_1$.

The cylinder section 9 serves essentially for sealing the interior of the cartridge. It must therefore have a sidewall area which is so large that the interior of the cartridge is optimally sealed even during displacement of the piston 6. The cylinder section 9 is therefore preferably at least as large as the cylinder section 10.

The sidewall 8 as a whole must moreover be so long that the piston 6 retains its axial orientation when the material is being forced out of the cartridge 1 and does not adopt a skew position.

From the drawing, it is also evident that the press piston 6 has, on its end face 7, a central, circular bulge 12 and six radially arranged notches 13 which extend outwards from the bulge 12 and in turn are oriented symmetrically so that their axial extensions are in each case between two adjacent bevels 11. Both the bulge 12 and the notches 13 serve essentially for forming a dimensionally rigid and stable end wall 7 which withstands the pressure of the injection gun used for holding the cartridge.

Below, the use of the press piston according to the invention is described briefly.

In a first step, the container part 2 additionally having a wax layer in the rear end section 5 is filled with flowable material.

The container part 2 is then fed to a press which is coordinated with the filling or closing line and by means of which a piston 6 is pressed into the open end section 5 of the container part 2. The material of container part 2 and piston 6 should furthermore be tailored to one another in such a way that, if the external diameter of the piston 6 is slightly larger than the internal diameter of container part, the cylindrical wall of the container part slightly deforms and expands when the piston 6 is pressed in.

When the piston 6 is pressed in, the air present in the interior of the cartridge and displaced by the penetrating piston 6 escapes outwards through passages briefly formed by the bevels 11, so that no excess pressure is generated in the interior of the cartridge, and the piston 6 thus remains in the inserted state.

Both the wall thicknesses and the dimensions of the internal diameter and external diameter of the container part 2 and piston 6, respectively, should be tailored to one another so that a fluid- and gas-tight seal is ensured. The above-mentioned wall thicknesses and dimensions of the press piston according to the invention are therefore empirical values which arise from the numerous tests and may differ with a different choice of material and cartridge size. Pistons according to the invention may therefore have shapes and dimensions differing from the embodiment shown.

What is claimed is:

1. A cylindrical piston for insertion into a cylindrical container part of a cartridge for holding a flowable material, the piston comprising a cylindrical side wall having an external diameter at least equal to an internal diameter of the cylindrical container part of the cartridge so that the piston can be pressed into the cylindrical container part with a tight fit; an end wall closing the cylindrical side wall at one end of the cylindrical side wall; and at least one bevel extending from the end wall to a surface of the cylindrical side wall, the bevel forming, together with a cylindrical wall of the cylindrical container part, for a short time, a passage through which air can escape when the air is displaced upon the piston being pressed into the cylindrical container part, and a cylindrical wall section, which has the at least one bevel, having a length equal to at least one fourth (¼ ) and not more than two third (β) of an entire length of the side cylindrical wall.

2. A piston according to claim 1, comprising at least two bevels uniformly distributed around a circumference of the cylindrical side wall of the piston.

3. A piston according to claim 1, comprising four bevels uniformly distributed around a circumference of the cylindrical side wall of the piston.

4. A piston according to claim 1, comprising six bevels uniformly distributed around a circumference of the cylindrical side wall of the piston.

5. A piston according to claim 1, wherein the external diameter of the side cylindrical wall of the piston does not excedes the internal diameter of the cylindrical container part by more than 2%.

6. A piston according to claim 1, wherein a width of the at least one bevel decreases with a distance thereof from the end wall increasing.

7. A piston according to claim 1, wherein the piston is formed of aluminum.

* * * * *